US012358742B2

(12) United States Patent
Kaiga et al.

(10) Patent No.: US 12,358,742 B2
(45) Date of Patent: Jul. 15, 2025

(54) CONVEYANCE APPARATUS AND IMAGE FORMING APPARATUS

(71) Applicant: CANON KABUSHIKI KAISHA, Tokyo (JP)

(72) Inventors: Miho Kaiga, Shizuoka (JP); Naoki Hayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 198 days.

(21) Appl. No.: 18/159,615

(22) Filed: Jan. 25, 2023

(65) Prior Publication Data

US 2023/0242362 A1 Aug. 3, 2023

(30) Foreign Application Priority Data

Feb. 2, 2022 (JP) ..... 2022-014684

(51) Int. Cl.
*B65H 5/36* (2006.01)
*B65H 5/06* (2006.01)

(52) U.S. Cl.
CPC ..... *B65H 5/062* (2013.01); *B65H 5/36* (2013.01); *B65H 2601/51* (2013.01)

(58) Field of Classification Search
CPC .. B65H 5/062; B65H 5/36; B65H 2404/6111; B65H 2404/612; B65H 2801/06; B65H 9/004; B65H 9/06; B65H 2701/1131; G03G 2215/00679; G03G 15/6529; G03G 15/6567; G03G 15/6576
USPC ..... 271/188, 189, 245
See application file for complete search history.

(56) References Cited

U.S. PATENT DOCUMENTS

| | | | | |
|---|---|---|---|---|
| 6,011,948 | A * | 1/2000 | Amano | B65H 9/06 271/245 |
| 6,934,505 | B2 | 8/2005 | Shin | |
| 9,027,923 | B2 * | 5/2015 | Suzuki | G03G 15/6567 271/242 |
| 9,238,560 | B1 | 1/2016 | Toba | |
| 9,676,572 | B2 * | 6/2017 | Kaiga | B65H 5/38 |
| 11,440,760 | B2 * | 9/2022 | Nagasaki | B65H 9/20 |
| 2015/0284199 | A1 | 10/2015 | Kaiga | |

(Continued)

FOREIGN PATENT DOCUMENTS

| | | | |
|---|---|---|---|
| JP | H04337747 | A | 11/1992 |
| JP | H061488 | A | 1/1994 |

(Continued)

*Primary Examiner* — Leslie A Nicholson, III
(74) *Attorney, Agent, or Firm* — Canon U.S.A., Inc. IP Division

(57) ABSTRACT

A conveyance apparatus for conveying a sheet includes (i) a first conveyance roller pair, (ii) a second conveyance roller pair configured to convey the sheet to reach a position where the sheet contacts the first conveyance roller pair, (iii) a moving member movable between a restricting position where the sheet is regulated not to reach the first conveyance roller pair and a retracting position, to be moved to the retracting position from the restricting position by being pushed by the sheet, (iv) a first guide disposed between the moving member and the second conveyance roller pair, and (v) a first opposing guide opposing the first guide. One of the first guide and the first opposing guide includes a first curved portion which the sheet contacts, and the other one thereof includes a second curved portion which the sheet contacts.

20 Claims, 4 Drawing Sheets

(56) References Cited

U.S. PATENT DOCUMENTS

| | | | | |
|---|---|---|---|---|
| 2017/0357190 | A1 | 12/2017 | Ishida | |
| 2020/0255242 | A1* | 8/2020 | Nagasaki | B65H 29/125 |

FOREIGN PATENT DOCUMENTS

| | | | |
|---|---|---|---|
| JP | 2010247981 | A | 11/2010 |
| JP | 2016150814 | A | 8/2016 |
| JP | 2020073406 | A | 5/2020 |
| JP | 2020128283 | A | 8/2020 |
| KR | 20120035520 | A | 4/2012 |
| KR | 20150037825 | A | 4/2015 |

* cited by examiner

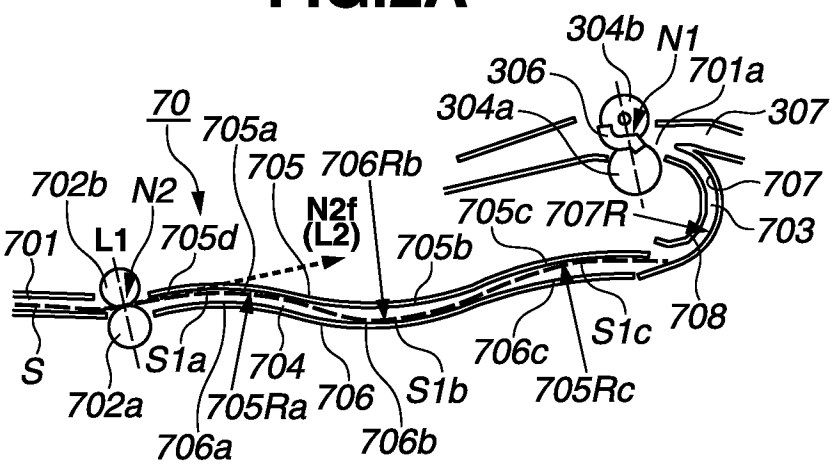
FIG.2A
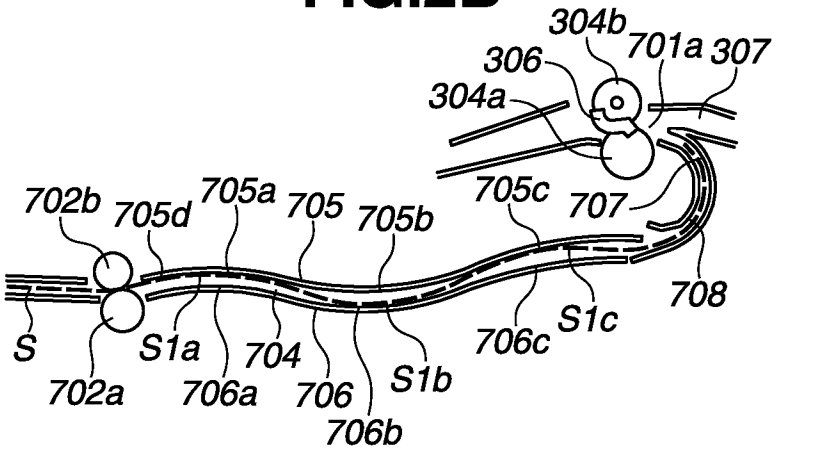
FIG.2B
FIG.2C
FIG.2D

CONVEYANCE APPARATUS AND IMAGE FORMING APPARATUS

BACKGROUND OF THE INVENTION

Field of the Invention

The present invention relates to a conveyance apparatus for conveying a sheet, and an image forming apparatus employing the conveyance apparatus.

Description of the Related Art

In general, an image forming apparatus, such as a copying machine, a printer, and a facsimile machine, includes a conveyance unit (conveyance apparatus) for conveying a sheet.

Japanese Patent Application Laid-open No. 2020-73406 discusses an image forming apparatus including a two-sided conveyance path configured to guide a sheet to a transfer unit again after forming an image on a first surface of the sheet with the transfer unit so that images can be formed on both sides of the sheet.

In the image forming apparatus discussed in Japanese Patent Application Laid-open No. 2020-73406, a sheet passes through the conveyance path curving in an S shape when the sheet is conveyed from a sheet stacking unit to a discharge tray via an image forming unit. The two-sided conveyance path is disposed under a conveyance path (one-sided conveyance path) through which a sheet passes when one-sided printing is performed.

When a sheet is conveyed, there may be a case where a force (resistance force) acts on the sheet in a direction in which the sheet conveyance is hindered by the sheet contacting other components. For example, in the image forming apparatus including the conveyance path curving in an S shape discussed in Japanese Patent Application Laid-open No. 2020-73406, there may be a case where the curvature of the conveyance path becomes large to increase the resistance force, at a position near a joint portion of the one-sided conveyance path and the two-sided conveyance path. Further, if the resistance force acting on the sheet is large, the sheet may buckle.

SUMMARY OF THE INVENTION

The present invention is directed to a conveyance apparatus for conveying a sheet capable of restraining buckling of a sheet.

According to an aspect of the present invention, a conveyance apparatus configured to convey a sheet includes a first conveyance roller pair configured to convey the sheet, the first conveyance roller pair including a first roller and a first opposing roller opposing the first roller, a second conveyance roller pair configured to convey the sheet toward the first conveyance roller pair, the second conveyance roller pair including a second roller and a second opposing roller opposing the second roller, the second conveyance roller pair configured to convey the sheet such that the sheet reaches a position at which the sheet contacts the first conveyance roller pair, a moving member configured to move between a restricting position at which the moving member restricts the sheet from reaching the first conveyance roller pair and a retracting position retracted from the restricting position, the moving member being moved from the restricting position to the retracting position by being pushed by the sheet, a first guide configured to guide the sheet conveyed by the second conveyance roller pair, the first guide being disposed between the moving member and the second conveyance roller pair, and a first opposing guide configured to guide the sheet conveyed by the second conveyance roller pair, the first opposing guide being disposed between the moving member and the second conveyance roller pair to oppose the first guide. One of the first guide and the first opposing guide includes a first curved portion which the sheet contacts, and the other of the first guide and the first opposing guide includes a second curved portion which the sheet contacts. The second conveyance roller pair conveys the sheet such that the sheet contacts the second curved portion after contacting the first curved portion.

Further features of the present invention will become apparent from the following description of exemplary embodiments with reference to the attached drawings.

BRIEF DESCRIPTION OF THE DRAWINGS

FIGS. 2A, 2B, 2C, and 2D are cross-section diagrams illustrating a two-sided conveyance unit according to the first exemplary embodiment.

DESCRIPTION OF THE EMBODIMENTS

Hereinbelow, exemplary embodiments of the present invention will be described in detail as examples with reference to the attached drawings. Note that dimensions, materials, and shapes of the constituent parts, and relative arrangements thereof described in the exemplary embodiments below should be changed appropriately depending on the configuration or various conditions of the apparatus to which the present invention is applied. Accordingly, the exemplary embodiments described below are not intended to limit the range of the present invention only thereto, unless otherwise specifically described.

Figure 1:
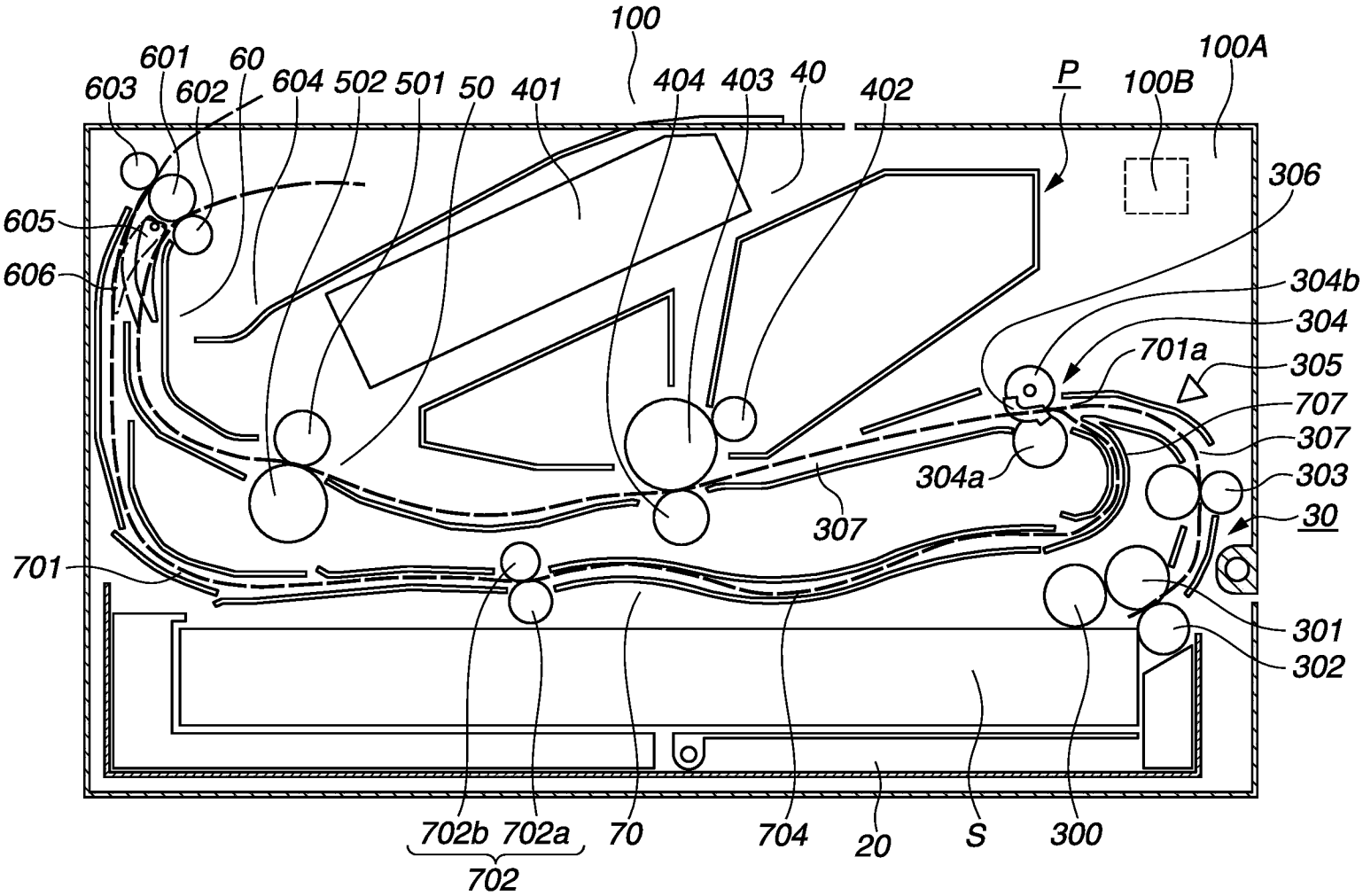
FIG. 1 is a cross-section diagram schematically illustrating a configuration of a printer according to a first exemplary embodiment.

A basic configuration and operation of a printer 100 serving as an image forming apparatus according to a first exemplary embodiment will now be described with reference to FIG. 1. FIG. 1 is a cross-section diagram schematically illustrating the configuration of the printer 100 according to the present exemplary embodiment.

The printer 100 according to the present exemplary embodiment is a laser beam printer that forms an image using an electrophotographic method to record the image on a recording medium (sheet).

The printer 100 that forms an image on a sheet S includes an apparatus main body 100A, a sheet feed cassette 20 as a sheet stacking unit for stacking sheets S, a sheet feed-conveyance unit 30, an image forming unit 40, a fixing unit 50, a discharge sheet reversing unit 60, and a two-sided conveyance unit 70. The printer 100 includes a control unit 100B for executing an image forming operation on the sheet S.

In the printer 100, a portion having a function of conveying the sheet S can also be referred to as a conveyance apparatus of the sheet S. In other words, the printer 100 can also be said to include the conveyance apparatus for the sheet S. For example, the sheet feed cassette 20, the sheet feed-conveyance unit 30, a photosensitive drum 403 (described below), a transfer roller 404, the fixing unit 50, the discharge sheet reversing unit 60, the two-sided conveyance unit 70, and a sheet discharge tray 604 (described below) are part of the conveyance apparatus according to the present exemplary embodiment. Further, the conveyance apparatus may include a conveyance path through which the sheet S passes, and a guide member that forms the conveyance path to guide the sheet S.

The sheet feed-conveyance unit 30 includes a pick roller (sheet feed roller or pickup roller) 300, a conveyance roller 301, a separation roller 302 contacting the conveyance roller 301, an intermediate roller pair 303, a registration roller pair 304, and a registration shutter (shutter) 306, which is also referred to as a moving member. The registration roller pair 304 is a first conveyance roller pair conveying the sheet S toward the image forming unit 40. The registration roller pair 304 includes a registration roller (first roller) 304*b* and a drive roller (first opposing roller) 304*a*. The registration roller 304*b* and the drive roller 304*a* oppose and contact each other. The registration roller 304*b* is rotated by the drive roller 304*a*.

A path through which the sheet S conveyed from the sheet feed cassette 20 toward the image forming unit 40 passes is referred to as a first conveyance path 307. The conveyance roller 301, the separation roller 302, the intermediate roller pair 303, the registration roller pair 304, and the shutter 306 are disposed on the first conveyance path 307. The first conveyance path 307 may include a path extending from the image forming unit 40 to the discharge sheet reversing unit 60.

The image forming unit 40 forms an image on the sheet S conveyed from the sheet feed cassette 20. The image forming unit 40 includes the photosensitive drum (image baring member) 403 that bears an electrostatic latent image, and a developing roller (developer bearing member) 402 that bears toner serving as developer and develops with the toner the electrostatic latent image formed on the photosensitive drum 403. The image forming unit 40 also includes a laser scanner 401 serving as an exposure device and the transfer roller (transfer member) 404 disposed opposing the photosensitive drum 403. The laser scanner 401 exposes the photosensitive drum 403 with a laser beam to form on the photosensitive drum 403 the electrostatic latent image corresponding to image information.

In the present exemplary embodiment, a cartridge P including the photosensitive drum 403, toner, and the developing roller 402 is detachably attached to the apparatus main body 100A of the printer 100.

When the image information and an image forming instruction are output to the printer 100 from an external apparatus, such as a computer, connected to the printer 100, the printer 100 starts an image forming process (image forming operation) performed by the image forming unit 40 on the sheet S based on the image information.

The photosensitive drum 403 is charged by a charging device (not illustrated). The laser scanner 401 radiates a laser beam to the photosensitive drum 403 based on the input image information. The radiated laser beam forms an electrostatic latent image corresponding to the image information on the photosensitive drum 403. Based on the electrostatic latent image formed on the photosensitive drum 403, toner is supplied to the photosensitive drum 403 from the developing roller 402, and a toner image is formed on the photosensitive drum 403.

In contrast, along with the image forming operation described above, a sheet S stacked in the sheet feed cassette 20 is conveyed by the pick roller 300. In a case where a plurality of sheets S is conveyed, one sheet S is separated from the plurality of sheets S at a separation nip formed between the conveyance roller 301 and the separation roller 302, and conveyed. The conveyed sheet S is further conveyed to the registration roller pair 304 via the intermediate roller pair 303.

The shutter 306 is disposed near the registration roller 304*b*. The shutter 306 is configured to be coaxially rotatable with the registration roller 304*b*. In other words, the shutter 306 and the registration roller 304*b* are configured to be rotatable around a first axis line common in the shutter 306 and the registration roller 304*b*.

The shutter 306 is a movable or moving member movable between a restricting position at which the shutter 306 restricts the sheet S from reaching the registration roller pair 304, and a retracting position retracted from the restricting position. The sheet S can contact the registration roller pair 304 when the shutter 306 is moved to the retracting position. The shutter 306 is moved from the restricting position to the retracting position by being pushed by the sheet S.

More specifically, the shutter 306 is positioned at the restricting position when the shutter 306 is not in contact with the sheet S. When a leading edge of the sheet S contacts the shutter 306 positioned at the restricting position, the sheet S is bent to form a loop. As a result, the skew of the sheet S is corrected. Thereafter, the shutter 306 is pushed up by a force received from the conveyed sheet S, and moved to the retracting position. When the shutter 306 is pushed up, the sheet S reaches a nip portion of the registration roller pair 304 formed by the registration roller 304*b* and the drive roller 304*a*, and conveyed by the registration roller pair 304.

The sheet S is conveyed by the registration roller pair 304 toward a transfer nip (transfer portion) formed by the photosensitive drum 403 and the transfer roller 404. A transfer bias is applied to the transfer roller 404 from a power source (not illustrated), and the toner image formed on the photosensitive drum 403 is transferred onto the sheet S at the transfer nip.

The fixing unit 50 includes a fixing roller 501 and a pressure roller 502. The sheet S having passed through the transfer nip is heated and pressurized by the fixing roller 501 and the pressure roller 502, to fix the toner image onto the sheet S.

The discharge sheet reversing unit 60 includes a discharge roller 601, a first driven roller 602, and a second driven roller 603. The sheet discharge tray 604 is provided on top of the apparatus main body 100A.

In a case where one-sided printing to print an image on one side of the sheet S is performed, the sheet S on which the toner image has been fixed is conveyed by the discharge roller 601 and the first driven roller 602 to be discharged onto the sheet discharge tray 604. In a case where two-sided printing of printing images on both side of the sheet S is performed, the sheet S on which the toner image has been fixed is not discharged onto the sheet discharge tray 604, and conveyed toward the two-sided conveyance unit 70.

More specifically, a movable reversing guide 605 is disposed on the downstream side of the fixing unit 50.

The sheet S with a toner image fixed on a first surface (front surface) thereof is guided to a reversing conveyance path 606 by the reversing guide 605, and conveyed to a predetermined position by the discharge roller 601 and the second driven roller 603. Thereafter, the driving direction of the discharge roller 601 is reversed to reverse the conveyance direction of the sheet S, and the sheet S is conveyed to a two-sided conveyance path 701.

The two-sided conveyance path 701 is a second conveyance path through which the sheet S conveyed toward the image forming unit 40 again after the image is formed by the image forming unit 40 passes. The two-sided conveyance path 701 is connected with the first conveyance path 307 at a junction 701*a*. After passing through the image forming unit 40 (more specifically, transfer portion), the sheet S passes through the two-sided conveyance path 701, enters the first conveyance path 307 from the junction 701*a*, and is conveyed again toward the image forming unit 40 and the transfer portion. The registration roller pair 304 and the shutter 306 are disposed between the junction 701*a* and the image forming unit 40.

On the two-sided conveyance path 701, a two-sided conveyance roller pair 702 is provided through which the sheet S is conveyed toward the registration roller pair 304. The sheet S conveyed to the two-sided conveyance path 701 passes through a relay conveyance path 704, which is a part of the two-sided conveyance path 701, by the two-sided conveyance roller pair 702, is curved by an outside turn guide 707, and is conveyed again to the registration roller pair 304.

Thereafter, an image is formed on a second surface (back surface) of the sheet S by the image forming unit 40. In other words, toner is transferred on the second surface at the transfer nip. The sheet S with the toner transferred on the second surface thereof is discharged, similarly to the case of the one-sided printing, onto the sheet discharge tray 604 via the fixing unit 50.

As described above, in the printer 100 according to the present exemplary embodiment, the sheet S is conveyed so as to form a locus of an S shape, from the sheet feed cassette 20 to the discharge sheet reversing unit 60. The sheet S is conveyed so as to contact a lower part of the photosensitive drum 403, after being bent in a direction opposite to a direction in which the sheet S is fed out from the sheet feed cassette 20.

In FIG. 1, rotational axises of a two-sided conveyance roller 702*a*, a driven roller 702*b*, the drive roller 304*a*, the registration roller 304*b*, the pick roller 300, and the photosensitive drum 403 are parallel to each other.

When viewed in the rotational axis direction of the registration roller 304*b*, the distance between the pick roller 300 and one end (first end) of the apparatus main body 100A is shorter in the horizontal direction than the distance between the pick roller 300 and the other end (second end opposite to first end) of the apparatus main body 100A. In other words, the pick roller 300 is located nearer to the one end of the apparatus main body 100A than to the other end of the apparatus main body 100A. In contrast, the distance between the discharge sheet reversing unit 60 and the other end of the apparatus main body 100A is shorter than the distance between the discharge sheet reversing unit 60 and the one end of the apparatus main body 100A. In other words, the discharge sheet reversing unit 60 is located nearer to the other end of the apparatus main body 100A than to the one end of the apparatus main body 100A.

Further, the two-sided conveyance path 701 passes below the photosensitive drum 403 and above the sheet feed cassette 20. In the horizontal direction, the two-sided conveyance path 701 extends from one side of the photosensitive drum 403 to the other side of the photosensitive drum 403.

<Two-Sided Conveyance Unit>

With reference to FIGS. 1, 2A, 2B, 2C, and 2D, the two-sided conveyance unit 70 will be described in detail. FIGS. 2A, 2B, 2C, and 2D are cross-section diagrams illustrating the two-sided conveyance unit 70 according to the present exemplary embodiment.

The two-sided conveyance unit 70 includes the two-sided conveyance pair (second conveyance roller pair) 702, the outside turn guide 707, an inside turn guide 708, an upper side conveyance guide 705, and a lower side conveyance guide 706 (described below).

In a conveyance path extending from the two-sided conveyance roller pair 702 to the registration roller pair 304, the two-sided conveyance roller pair 702 is disposed next to the registration roller pair 304, and delivers the leading edge of the sheet S to the registration roller pair 304. More specifically, the two-sided conveyance roller pair 702 conveys the sheet S immediately before the registration roller pair 304 to convey the sheet S so that the sheet S reaches a position at which the sheet S contacts the registration roller pair 304. In other words, the two-sided conveyance roller pair 702 conveys the sheet S until the leading edge of the sheet S passes over the nip portion of the registration roller pair 304 formed by the registration roller 304*b* and the drive roller 304*a*. The two-sided conveyance roller pair 702 includes the two-sided conveyance roller (second roller) 702*a* and the driven roller (second opposing roller) 702*b*. The two-sided conveyance roller 702*a* and the driven roller 702*b* oppose and contact each other.

In the present exemplary embodiment, a sheet of a minimum size that can be handled by the printer 100 due to the specification of the printer 100 is referred to as a minimum sheet. The minimum sheet is a sheet having a minimum size from among sheets S that can be conveyed and on which image forming operation can be performed by the printer 100. The minimum sheet in the present exemplary embodiment refers to a sheet on which two-sided printing can be performed, and more specifically, refers to a sheet having a minimum size from among the sheets S that can be conveyed by the registration roller pair 304 and the two-sided conveyance roller pair 702.

Further, the length of the sheet S along the conveyance direction thereof is referred to as a sheet length. The sheet length of the minimum sheet is specifically referred to as a shortest length.

The position of the two-sided conveyance roller pair 702 with respect to the registration roller pair 304 is set based on the distance with which both of the two-sided conveyance roller pair 702 and the registration roller pair 304 can nip the minimum sheet at a time (e.g., at the same time). In this way, the minimum sheet can be delivered from the two-sided conveyance roller pair 702 to the registration roller pair 304.

More specifically, the position of the two-sided conveyance roller pair 702 with respect to the registration roller pair 304 is set based on the following formula.

(Nip position N1 of registration roller pair 304)−(nip position N2 of two-sided conveyance roller pair 702)=(shortest length)−(maximum bending amount)−(minimum sheet tolerance)−(leading edge projecting amount)−(trailing edge projecting amount) (1)

In the formula (1), the nip position N1 is a position at which the registration roller pair 304 nips the sheet S, and is a position of a contact portion (first nip portion or first contact portion) at which the registration roller 304*b* and the drive roller 304*a* contact. The nip position N2 is a position at which the two-sided conveyance roller pair 702 nips the sheet S, and is a position of a contact portion (second nip portion or second contact portion) at which the two-sided conveyance roller 702*a* and the driven roller 702*b* contact. The maximum bending amount is a value used for taking in consideration an influence exerted when the minimum sheet bends most in the conveyance path between the registration roller pair 304 and the two-sided conveyance roller pair 702.

Further, in order to securely convey the sheet S with the two-sided conveyance roller pair 702 and the registration roller pair 304, it is desirable to convey the sheet S with the two-sided conveyance roller pair 702 until the leading edge of the sheet S overruns the first nip portion by a predetermined amount. Further, it is desirable that the trailing edge of the sheet S is in a state of projecting from the second nip portion by a predetermined amount, when the leading edge of the sheet S has projected from the first nip portion by a predetermined amount. The projecting amount of the leading edge side of the sheet S from the first nip portion is referred to as a leading edge projecting amount, and the projecting amount of the trailing edge side of the sheet S from the second nip portion is referred to as a trailing edge projecting amount.

Further, in order to reduce the designing constraint on the printer 100 and the size of the printer 100, the two-sided conveyance roller pair 702 may be disposed at a position far from the registration roller pair 304 and the outside turn guide 707. The degree of freedom of design of the printer 100 increases if the two-sided conveyance roller pair 702 can be disposed at a position far from the registration roller pair 304 and the outside turn guide 707. Further, it is also possible to reduce the number of roller pairs arranged on the entire conveyance path of the sheet S by increasing the distance between one roller pair and a next roller pair that is a roller pair to convey the sheet S immediately before the one roller pair.

The distance between the two-sided conveyance roller pair 702 and the registration roller pair 304 along the conveyance path of the sheet S can be 45% or more of the shortest length. In other words, when the minimum sheet is nipped by the registration roller pair 304 and the two-sided conveyance roller pair 702, a part of 45% or more of the shortest length is located between the registration roller pair 304 and the two-sided conveyance roller pair 702. In the present exemplary embodiment, the minimum sheet for the printer 100 is an A5 size sheet, and the shortest length is 210 mm (millimeters). When the sheet S is nipped by the registration roller pair 304 and the two-sided conveyance roller pair 702, 100 mm or more of the sheet S is located between the registration roller pair 304 and the two-sided conveyance roller pair 702, accordingly.

In the present exemplary embodiment, the distance between the two-sided conveyance roller pair 702 and the registration roller pair 304 along the conveyance path of the sheet S is 85% or more and 95% or less (more specifically, 90%) of the shortest length. In other words, a part of 85% or more and 95% or less (more specifically, 90%) of the shortest length is located between the registration roller pair 304 and the two-sided conveyance roller pair 702, when the minimum sheet is nipped by the registration roller pair 304 and the two-sided conveyance roller pair 702. When the sheet S is nipped by the registration roller pair 304 and the two-sided conveyance roller pair 702, 180 mm or more of the sheet S is located between the registration roller pair 304 and the two-sided conveyance roller pair 702, accordingly.

The printer 100 may include a detection unit 305 for detecting the sheet length of the sheet S to be conveyed. The control unit 100B may restrict the image forming operation on the sheet S or the conveyance operation of the sheet S when the detection unit 305 detects that the sheet length is out of a predetermined range. For example, in a case where the sheet length of the conveyed sheet S is shorter than the shortest length, the control unit 100B may restrict the image forming operation on the sheet S or the conveyance operation of the sheet S.

Guide members arranged on the two-sided conveyance path 701 will now be described.

The outside turn guide 707 and the inside turn guide 708 are disposed on the upstream side of the registration roller pair 304, the shutter 306, and the junction 701*a* in the conveyance direction of the sheet S from the two-sided conveyance roller pair 702 toward the registration roller pair 304. The outside turn guide (U turn guide, bending guide, return guide, second guide, or second curved guide) 707 and the inside turn guide 708 are disposed on the two-sided conveyance path 701, and more specifically, disposed between the relay conveyance path 704 and the junction 701*a*.

The outside turn guide 707 guides the sheet S that has been conveyed by the two-sided conveyance roller pair 702 toward the registration roller pair 304. The sheet S is bent by contacting the outside turn guide 707, and the moving direction of the leading edge of the sheet S is changed from a direction away from the registration roller pair 304 and the shutter 306, to a direction approaching the registration roller pair 304 and the shutter 306. In other words, the outside turn guide 707 turns around the sheet S and guides the sheet S toward the registration roller pair 304 and the shutter 306. In the state where the leading edge of the sheet S is moving in the direction away from the registration roller pair 304 and the shutter 306, the linear distance between the leading edge of the sheet S, and the registration roller pair 304 and the shutter 306 increases. In the state where the leading edge of the sheet S is moving in the direction approaching the registration roller pair 304 and the shutter 306, the linear distance between the leading edge of the sheet S, and the registration roller pair 304 and the shutter 306 decreases.

Between the outside turn guide 707 and the inside turn guide 708, a return path (U-turn path) 703 is formed. The sheet S which is bent and turned around as described above passes through the return path 703. The outside turn guide 707 is disposed outside (outside in a radial direction of the curvature) the curved return path 703, and the inside turn guide 708 is disposed inside (inside in the radial direction of the curvature) the curved return path 703.

The upper side conveyance guide (first guide or first curved guide) 705, and the lower side conveyance guide (first opposing guide or first opposing curved guide) 706 opposing the upper side conveyance guide 705 are disposed on the two-sided conveyance path 701. The upper side conveyance guide 705 and the lower side conveyance guide 706 are configured to guide the sheet S conveyed by the two-sided conveyance roller pair 702.

The upper side conveyance guide 705 and the lower side conveyance guide 706 are located between the shutter 306 and the two-sided conveyance roller pair 702. The upper side conveyance guide 705 and the lower side conveyance guide 706 can also be said to be located between the registration roller pair 304 and the two-sided conveyance roller pair 702, or to be located between the outside turn guide 707 and the two-sided conveyance roller pair 702.

The relay conveyance path 704 of the two-sided conveyance path 701 is formed between the upper side conveyance guide 705 and the lower side conveyance guide 706. The upper side conveyance guide 705 is disposed above the lower side conveyance guide 706 in the vertical direction.

On the sheet S, a frictional resistance received from the outside turn guide 707 acts. Further, on the sheet S, a reaction force received from the shutter 306 acts. The frictional resistance of the sheet S received from the outside turn guide 707 and the reaction force received from the shutter 306 can be referred to as a force (resistance force or conveyance resistance force) acting in the direction in which the conveyance of the sheet S is hindered.

In the conveyance path of the printer 100 according to the present exemplary embodiment or the like, it is preferable to reduce the radius of the outside turn guide 707 to increase the curvature thereof in order to reduce the size of the printer 100. However, in this case, the frictional resistance which the sheet S receives from the outside turn guide 707 also increases. Further, since the two-sided conveyance roller pair 702 is disposed at a position far from the registration roller pair 304, the distance of the two-sided conveyance roller pair 702 from each of the registration roller pair 304, the shutter 306, and the outside turn guide 707 is long.

If the resistance force received by the sheet S is large, the sheet S buckles to cause a plurality of small creases to occur, and, for example, it may become hard to push up the shutter 306 appropriately.

This phenomenon is likely to occur when a thin sheet S is used. Further, as the distance from the upstream side conveyance roller pair (e.g., two-sided conveyance roller pair 702) to the downstream side conveyance roller pair (e.g., registration roller pair 304) is longer, the phenomenon is more likely to occur.

According to the study by the inventors, when the sheet S is nipped by the registration roller pair 304 and the two-sided conveyance roller pair 702, the phenomenon is likely to occur in a case where the sheet S is located between the registration roller pair 304 and the two-sided conveyance roller pair 702 for a distance of 100 mm or more. When the sheet S is nipped by the registration roller pair 304 and the two-sided conveyance roller pair 702, the phenomenon is more likely to occur in a case where the sheet S is located between the registration roller pair 304 and the two-sided conveyance roller pair 702 for a distance of 180 mm or more. In other words, making the distance long between the registration roller pair 304 and the two-sided conveyance roller pair 702 brings an advantage to increase the degree of freedom of design of the printer 100, but brings the buckling of the sheet S to occur easily.

The printer 100 according to the present exemplary embodiment restrains the buckling of the sheet S by providing a curved portion in each of the upper side conveyance guide 705 and the lower side conveyance guide 706 to bend the sheet S largely.

The shapes of the upper side conveyance guide 705 and the lower side conveyance guide 706 according to the present exemplary embodiment will now be described in detail with reference to FIGS. 2A to 2D. FIGS. 2A to 2D are diagrams viewed along the rotational axis direction of the two-sided conveyance roller 702*a*.

In FIGS. 2A to 2D, a direction orthogonal to the conveyance direction and the thickness direction of the sheet S is referred to as a width direction of the sheet S. The width direction is parallel to the direction of the rotational axis of each of the two-sided conveyance roller 702*a*, the driven roller 702*b*, the drive roller 304*a*, and the registration roller 304*b*.

The upper side conveyance guide 705 includes a first upper side curved portion (first curved portion) 705*a*, a second upper side curved portion 705*b*, and a third upper side curved portion (third curved portion) 705*c* each having a predetermined curvature. The second upper side curved portion 705*b* is disposed between the first upper side curved portion 705*a* and the third upper side curved portion 705*c*. The first upper side curved portion 705*a* and the third upper side curved portion 705*c* are disposed at positions apart from each other.

The lower side conveyance guide 706 includes a first lower side curved portion 706*a*, a second lower side curved portion (second curved portion) 706*b*, and a third lower side curved portion 706*c* each having a predetermined curvature. The second lower side curved portion 706*b* is disposed between the first lower side curved portion 706*a* and the third lower side curved portion 706*c*. The first lower side curved portion 706*a* and the third lower side curved portion 706*c* are disposed at positions apart from each other.

Each of the first upper side curved portion 705*a* and the third upper side curved portion 705*c* is a curved portion (curved surface) curving such that the surface thereof opposing the sheet S or the relay conveyance path 704 becomes concave. Each of the first upper side curved portion 705*a* and the third upper side curved portion 705*c* can be said to be a curved surface curving in a direction away from the sheet S or the relay conveyance path 704 in the thickness direction of the sheet S (i.e., direction orthogonal to the conveyance direction and the width direction of the sheet S). The second upper side curved portion 705*b* is a curved portion (curved surface) curving such that the surface thereof opposing the sheet S or the relay conveyance path 704 becomes convex. The second upper side curved portion 705*b* can be said to be a curved surface curving in a direction approaching the sheet S or the relay conveyance path 704 in the thickness direction of the sheet S. In the present exemplary embodiment, each of the first upper side curved portion 705*a*, the second upper side curved portion 705*b*, and the third upper side curved portion 705*c* has an arc shape.

Each of the first lower side curved portion 706*a* and the third lower side curved portion 706*c* is a curved portion (curved surface) curving such that the surface thereof opposing the sheet S or the relay conveyance path 704 becomes convex. Each of the first lower side curved portion 706*a* and the third lower side curved portion 706*c* can be said to be a curved surface curving in a direction approaching the sheet S or the relay conveyance path 704 in the thickness direction of the sheet S (i.e., direction orthogonal to the conveyance direction and the width direction of the sheet S). The second lower side curved portion 706*b* is a curved portion (curved surface) curving such that the surface opposing the sheet S or the relay conveyance path 704 becomes concave. The second lower side curved portion 706*b* can be said to be a curved surface curving in a direction away from the sheet S or the relay conveyance path 704 in the thickness direction of the sheet S. In the present exemplary embodiment, each of the first lower side curved portion 706*a*, the second lower side curved portion 706*b*, and the third lower side curved portion 706*c* has an arc shape.

The first upper side curved portion 705*a* and the first lower side curved portion 706*a* oppose each other to form a curved conveyance path through which the sheet S passes. The second upper side curved portion 705*b* and the second lower side curved portion 706*b* oppose each other to form a curved conveyance path through which the sheet S passes. The third upper side curved portion 705*c* and the third lower side curved portion 706*c* oppose each other to form a curved conveyance path through which the sheet S passes.

The two-sided conveyance roller pair 702 conveys the sheet S so that the sheet S contacts the first upper side curved portion 705*a*, and the second lower side curved portion 706*b* in this order, to thereafter contact the third upper side curved portion 705*c*.

In this case, viewed in the rotational axis direction of the two-sided conveyance roller 702*a*, a straight line connecting the rotational center of the two-sided conveyance roller 702*a* and the rotational center of the driven roller 702*b* is defined as a first straight line L1. Further, a straight line orthogonal to the first straight line L1 and passing through the position (second nip portion N2) at which the two-sided conveyance roller 702*a* and the driven roller 702*b* contact is defined as a second straight line L2. In the present exemplary embodiment, the second straight line L2 is a tangent line (common tangent line) of the two-sided conveyance roller 702*a* and the driven roller 702*b*.

The two-sided conveyance roller pair 702 pushes out the sheet S along the second straight line L2. The direction in which the two-sided conveyance roller pair 702 pushes out and conveys the sheet S is referred to as a push-out direction N2*f*. The push-out direction N2*f* is a moving direction of the sheet S at a portion between the two-sided conveyance roller 702*a* and the driven roller 702*b*.

The first upper side curved portion 705*a* is disposed on the downstream side of the two-sided conveyance roller pair 702 in the conveyance direction of the sheet S by the two-sided conveyance roller pair 702 so that the second straight line L2 and the first upper side curved portion 705*a* intersect.

Further, an upper guide entrance portion (parallel portion) 705*d* is disposed between the two-sided conveyance roller pair 702 and the first upper side curved portion 705*a* to be parallel to the second straight line L2.

As illustrated in FIG. 2A, the sheet S passing through the two-sided conveyance path 701 is nipped by the two-sided conveyance roller pair 702 to proceed to the push-out direction N2*f*, and the sheet S proceeds along the upper guide entrance portion 705*d*, to thereafter contact the first upper side curved portion 705*a*.

The sheet S contacting the first upper side curved portion 705*a* is guided by the first upper side curved portion 705*a* from the upper side conveyance guide 705 toward the lower side conveyance guide 706 so as to form an arc S1*a*, and the sheet S contacts the second lower side curved portion 706*b*.

The sheet S contacting the second lower side curved portion 706*b* is guided by the second lower side curved portion 706*b* from the lower side conveyance guide 706 toward the upper side conveyance guide 705 so as to form an arc S1*b*, and the sheet S contacts the third upper side curved portion 705*c*.

The sheet S contacting the third upper side curved portion 705*c* is guided by the third upper side curved portion 705*c* from the upper side conveyance guide 705 toward the lower side conveyance guide 706 so as to form an arc S1*c*, and the sheet S contacts the outside turn guide 707.

The sheet S is then conveyed along the outside turn guide 707 as illustrated in FIG. 2B. At this time, the sheet S is in a state of being likely to buckle due to the frictional resistance received from the outside turn guide 707. However, since the arcs S1*a*, S1*b*, and S1*c* are formed on the sheet S along the first upper side curved portion 705*a*, the second lower side curved portion 706*b*, and the third upper side curved portion 705*c*, the sheet S is kept bent with a desired curvature and the occurrence of the buckling can be prevented.

When the sheet S further proceeds, the leading edge of the sheet S reaches the shutter 306 as illustrated in FIG. 2C. The leading edge of the sheet S is regulated by the shutter 306, a loop is formed in the sheet S, and the skew of the sheet S is corrected. At this time, the sheet S is in a state of being likely to buckle due to the reaction force received from the shutter 306. However, since the arcs S1*a*, S1*b*, and S1*c* are formed on the sheet S along the first upper side curved portion 705*a*, the second lower side curved portion 706*b*, and the third upper side curved portion 705*c*, the sheet S is kept bent with a desired curvature and the occurrence of the buckling can be prevented.

When the skew of the sheet S is corrected, the entire sheet S in the width direction presses the shutter 306. In this state, when the conveyance force (pressing force) of the sheet S becomes larger than the holding force of holding the shutter 306 at the restricting position, the sheet S pushes up the shutter 306 and proceeds as illustrated in FIG. 2D. The sheet S having pushed up the shutter 306 to the retracting position reaches the first nip portion of the registration roller pair 304, and the sheet S is conveyed by the registration roller pair 304. In other words, the two-sided conveyance roller pair 702 is configured to convey the sheet such that the sheet (the sheet being conveyed by the two-sided conveyance roller pair 702) moves the shutter 306 from the restricting position to the retracting position and reaches a position at which the sheet contacts the first conveyance roller pair 304. The shutter 306 may also be positioned at the restricting position with its own weight, or with an urging member such as a spring.

As described above, in the printer 100 according to the present exemplary embodiment, the buckling of the sheet S can be restrained when the sheet S receives the frictional resistance from the outside turn guide 707. Further, when the sheet S receives the reaction force from the shutter 306, the buckling of the sheet S can be restrained.

Since the arcs S1*a*, S1*b*, and S1*c* are formed on the sheet S along the first upper side curved portion 705*a*, the second lower side curved portion 706*b*, and the third upper side curved portion 705*c*, the conveyance force use for the sheet S is applied, and the sheet S is conveyed to the registration roller pair 304. More specifically, the sheet S is curved by the first upper side curved portion 705*a*, the second lower side curved portion 706*b*, and the third upper side curved portion 705*c*, conveyed by the two-sided conveyance roller pair 702 in the curved state, and delivered to the registration roller pair 304. As a result, it is possible to restrain the buckling of the sheet S occurring between the two-sided conveyance roller pair 702 and the registration roller pair 304, or between the two-sided conveyance roller pair 702 and the shutter 306.

A radius 705Ra of the first upper side curved portion 705*a*, a radius 706Rb of the second lower side curved portion 706*b*, and a radius 705Rc of the third upper side curved portion 705*c* are larger than a radius 707R of the outside turn guide 707. The frictional resistances relieved from the first upper side curved portion 705*a*, the second lower side curved portion 706*b*, and the third upper side curved portion 705*c* are therefore smaller than the frictional resistance received from the outside turn guide 707. As a result, the buckling of the sheet S caused by the first upper side curved portion 705*a*, the second lower side curved portion 706*b*, and the third upper side curved portion 705*c* can be restrained.

According to the study by the inventors, the gap size between the first lower side curved portion 706*a* and the first upper side curved portion 705*a* is desirably 10 mm or less, and more desirably is 5 mm or less. The gap size between the second upper side curved portion 705*b* and the second lower side curved portion 706*b*, and the gap size between the third lower side curved portion 706*c* and the third upper side curved portion 705*c* are the same as the gap size described above. Further, the first lower side curved portion 706*a* and the first upper side curved portion 705*a* are concentrically disposed, the second upper side curved portion 705*b* and the second lower side curved portion 706*b* are concentrically disposed, and the third lower side curved portion 706*c* and the third upper side curved portion 705*c* are concentrically disposed.

In addition, the configurations of the first lower side curved portion 706*a*, the second upper side curved portion 705*b*, and the third lower side curved portion 706*c* are not limited to the configurations described above. The center of the radius of the first lower side curved portion 706*a* and the center of the radius 705Ra of the first upper side curved portion 705*a* may be different. The radius of the first lower side curved portion 706*a* may be the same as or different from the radius 705Ra of the first upper side curved portion 705*a*. The relationship between the second upper side curved portion 705*b* and the second lower side curved portion 706*b*, and the relationship between the third upper side curved portion 705*c* and the third lower side curved portion 706*c* are also similar to the relationship between the first lower side curved portion 706*a* and the first upper side curved portion 705*a*. Further, at least a part of each of the first lower side curved portion 706*a*, the second upper side curved portion 705*b*, and the third lower side curved portion 706*c* may be formed in a straight manner.

According to the study by the inventors, the radius 705Ra of the first upper side curved portion 705*a*, the radius 706Rb of the second lower side curved portion 706*b*, and the radius 705Rc of the third upper side curved portion 705*c* are desirably set to be 90 mm or more and 160 mm or less to restrain the buckling of the sheet S. This corresponds to a length of approximately 40% or more and 80% or less of the shortest length (210 mm).

Further, the radius 705Ra of the first upper side curved portion 705*a* can be made larger than the radius 706Rb of the second lower side curved portion 706*b*. The radius 705Rc of the third upper side curved portion 705*c* can be made larger than the radius 705Ra of the first upper side curved portion 705*a*.

Further, the radius 705Ra of the first upper side curved portion 705*a* can be made to be 125 mm or more and 145 mm or less. The radius 706Rb of the second lower side curved portion 706*b* can be made to be 90 mm or more and 110 mm or less. The radius 705Rc of the third upper side curved portion 705*c* can be made to be 140 mm or more and 160 mm or less.

<Configuration of Comparison Example>

A configuration of a comparison example will now be described with reference to FIGS. 3A, 3B, 3C, and 3D. FIGS. 3A to 3D are cross-section diagrams illustrating a two-sided conveying unit 170 according to the comparison example. The two-sided conveying unit 170 according to the comparison example includes an upper side conveyance guide 1705 and the lower side conveyance guide 1706 different in shape from the upper side conveyance guide 705 and the lower side conveyance guide 706, respectively. Other than those, the two-sided conveying unit 170 has the same configuration as that of the two-sided conveyance unit 70. Each of the upper side conveyance guide 1705 and the lower side conveyance guide 1706 has no curved portion, and is formed linearly. A relay conveyance path 1704 is formed between the upper side conveyance guide 1705 and the lower side conveyance guide 1706.

Figure 3A:
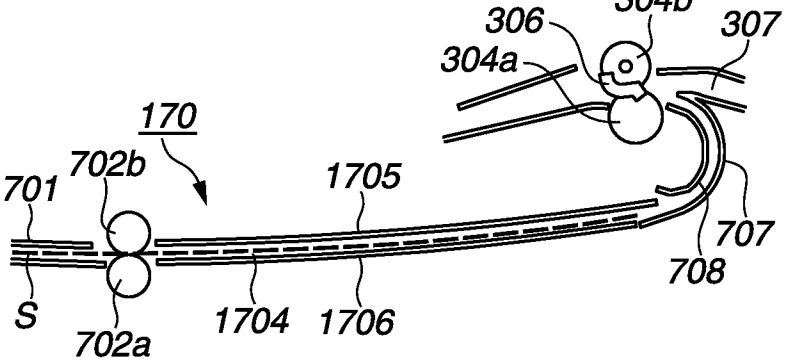
FIGS. 3A, 3B, 3C, and 3D are cross-section diagrams illustrating a two-sided conveyance unit according to a comparison example.

In FIG. 3A, the sheet S conveyed through the two-sided conveyance path 701 is conveyed to the relay conveyance path 1704 by the two-sided conveyance roller pair 702. The sheet S proceeds almost straight along the lower side conveyance guide 1706 to reach the outside turn guide 707.

Figure 3B:
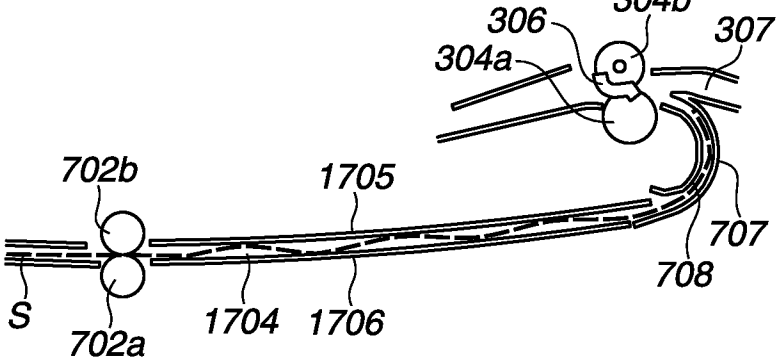

As illustrated in FIG. 3B, the sheet S is conveyed along the outside turn guide 707. At this time, the sheet S receives a frictional resistance from the outside turn guide 707. When the conveyance force of the sheet S becomes smaller than the frictional resistance, a small buckling begins to occur near the center of the sheet S in the relay conveyance path 1704.

Figure 3C:
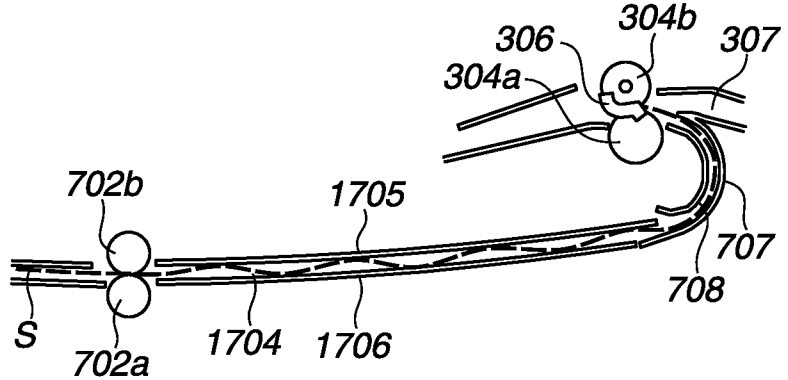

When the sheet S is further conveyed, the leading edge of the sheet S reaches the shutter 306 as illustrated in FIG. 3C. A loop is formed when the leading edge of the sheet S is brought into contact with the shutter 306, and the skew of the sheet S is corrected. However, the buckling further occurs in the relay conveyance path 1704 at a portion of the sheet S near the center to the trailing edge thereof when the sheet S receives the reaction force from the shutter 306.

Figure 3D:
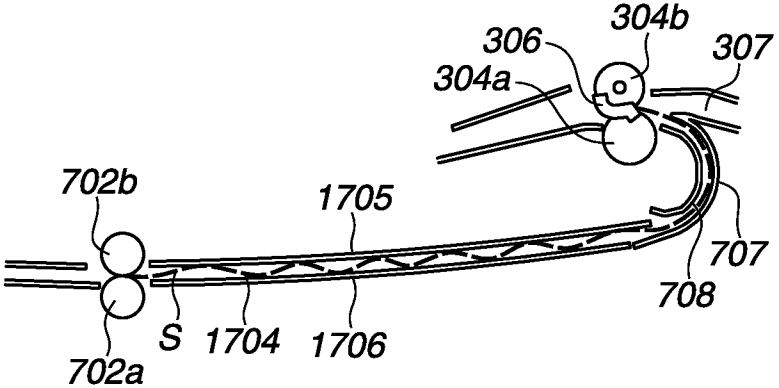

As a result, the sheet S cannot push up the shutter 306 and cannot reach the first nip portion of the registration roller pair 304 as illustrated in FIG. 3D. When the sheet S is further conveyed by the two-sided conveyance roller pair 702 in this state, the buckling of the sheet S further occurs in the relay conveyance path 1704. As a result, the normal conveyance of the sheet S is hindered.

The buckling of the sheet S caused by the frictional resistance from the outside turn guide 707 and the reaction force from the shutter 306 are likely to occur in a case where the sheet S is thin.

Modification Example

Figure 4:
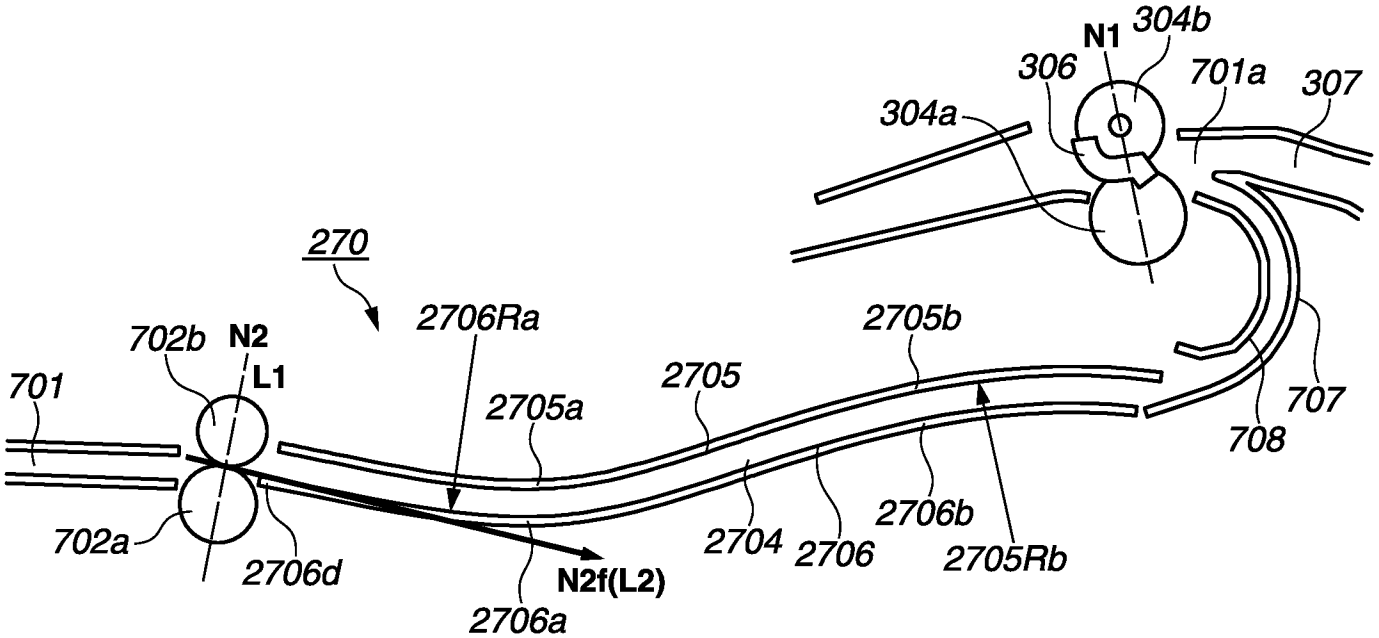
FIG. 4 is a cross-section diagram illustrating a two-sided conveyance unit according to a modification example.

A configuration of a modification example will now be described with reference to FIG. 4. FIG. 4 is a cross-section diagram illustrating a two-sided conveying unit 270 according to the modification example. The two-sided conveying unit 270 according to the modification example includes an upper side conveyance guide 2705 and a lower side conveyance guide 2706 respectively different in shape from the upper side conveyance guide 705 and the lower side conveyance guide 706. Other than those, the two-sided conveying unit 270 has the same configuration as that of the two-sided conveyance unit 70.

In the two-sided conveyance unit 70 illustrated in FIGS. 2A to 2D, the sheet S conveyed by the two-sided conveyance roller pair 702 successively contacts the first upper side curved portion 705*a*, the second lower side curved portion 706*b*, and the third upper side curved portion 705*c* in this order. However, the present invention is not limited to this configuration. The curved portions corresponding to the first upper side curved portion 705*a* and the third upper side curved portion 705*c* may be provided on one of the upper side conveyance guide 705 and the lower side conveyance guide 706, and the curved portion corresponding to the second lower side curved portion 706*b* can be provided on the other one of the upper side conveyance guide 705 and the lower side conveyance guide 706. Further, the curved portion corresponding to the third upper side curved portion 705*c* can be omitted.

More specifically, the lower side conveyance guide 2706 includes a first lower side curved portion (first curved portion) 2706*a* and a second lower side curved portion 2706*b* each having a predetermined curvature, as illustrated in FIG. 4. The upper side conveyance guide 2705 includes a first upper side curved portion 2705*a* and a second upper side curved portion (second curved portion) 2705*b* each having a predetermined curvature.

The upper side conveyance guide 2705 is disposed above the lower side conveyance guide 2706 in the vertical direction. A relay conveyance path 2704 is formed between the upper side conveyance guide 2705 and the lower side conveyance guide 2706.

The first lower side curved portion 2706*a* is a curved portion (curved surface) curving such that the surface thereof opposing the sheet S or the relay conveyance path 2704 becomes concave. The first lower side curved portion 2706*a* can be said to be a curved surface curving in a direction away from the sheet S or the relay conveyance path 2704 in the thickness direction of the sheet S. The second lower side curved portion 2706*b* is a curved portion (curved surface) curving such that the surface thereof opposing the sheet S or the relay conveyance path 2704 becomes convex. The second lower side curved portion 2706*b* can be said to be a curved surface curving in a direction approaching the sheet S or the relay conveyance path 2704 in the thickness direction of the sheet S. In the present exemplary embodiment, each of the first lower side curved portion 2706*a* and the second lower side curved portion 2706*b* has an arc shape.

The first upper side curved portion 2705*a* is a curved portion (curved surface) curving such that the surface thereof opposing the sheet S or the relay conveyance path 2704 becomes convex. The first upper side curved portion 2705*a* can be said to be a curved surface curving in a direction approaching the sheet S or the relay conveyance path 2704 in the thickness direction of the sheet S (direction orthogonal to the conveyance direction and the width direction of sheet S). The second upper side curved portion 2705*b* is a curved portion (curved surface) curving such that the surface thereof opposing the sheet S or the relay conveyance path 2704 becomes concave. The second upper side curved portion 2705*b* can be said to be a curved surface curving in a direction away from the sheet S or the relay conveyance path 2704 in the thickness direction of the sheet S. In the present exemplary embodiment, each of the first upper side curved portion 2705*a* and the second upper side curved portion 2705*b* has an arc shape.

The first lower side curved portion 2706*a* and the first upper side curved portion 2705*a*, oppose each other and form a curved conveyance path through which the sheet S passes. The second lower side curved portion 2706*b* and the second upper side curved portion 2705*b* oppose each other, and form a curved conveyance path through which the sheet S passes.

The two-sided conveyance roller pair 702 conveys the sheet S such that the sheet S contacts the first lower side curved portion 2706*a*, and thereafter, the sheet S contacts the second upper side curved portion 2705*b*.

Similarly to the configuration illustrated in FIGS. 2A to 2D, the buckling of the sheet S can be restrained by the sheet S curving along the first lower side curved portion (first curved portion) 2706*a* and the second upper side curved portion (second curved portion) 2705*b*.

The first lower side curved portion 2706*a* is disposed on the downstream side of the two-sided conveyance roller pair 702 in the conveyance direction of the sheet S by the two-sided conveyance roller pair 702 so that the second straight line L2 and the first lower side curved portion 2706*a* intersect. Further, a lower guide entrance portion (parallel portion) 2706*d* is disposed between the two-sided conveyance roller pair 702 and the first lower side curved portion 2706*a* to be parallel to the second straight line L2.

A radius 2706Ra of the first lower side curved portion 2706*a* is the same as the above-described radius 705Ra. A radius 2705Rb of the second upper side curved portion 2705*b* is the same as the above-described radius 706Rb.

The gap size between the first lower side curved portion 2706*a* and the first upper side curved portion 2705*a* is the same as the gap size between the above-described first upper side curved portion 705*a* and the first lower side curved portion 706*a*. The gap size between the second upper side curved portion 2705*b* and the second lower side curved portion 2706*b* is the same as the gap between the second lower side curved portion 706*b* and the second upper side curved portion 705*b*. The first lower side curved portion 2706*a* and the first upper side curved portion 2705*a* are concentrically disposed, and the second upper side curved portion 2705*b* and the second lower side curved portion 2706*b* are concentrically disposed.

The configuration of each of the first upper side curved portion 2705*a* and the second lower side curved portion 2706*b* is not limited to the above-described configuration. The center of the radius of the first upper side curved portion 2705*a* and the center of the radius of the first lower side curved portion 2706*a* may be different. The radius of the first upper side curved portion 2705*a* may be the same as or different from the radius of the first lower side curved portion 2706*a*. The relationship between the second lower side curved portion 2706*b* and the second upper side curved portion 2705*b* is the same as that described above. At least a part of each of the first upper side curved portion 2705*a* and the second lower side curved portion 2706*b* may be formed straight.

As described above, the occurrence of the buckling of the sheet S can be restrained to convey the sheet S stably, by providing the first curved portion on one of the upper side conveyance guide 705 (2705) and the lower side conveyance guide 706 (2706), and providing the second curved portion on the other one of the upper side conveyance guide 705 (2705) and the lower side conveyance guide 706 (2706).

Further, according to the present invention, it is possible to increase the distance from the registration roller pair 304 to the two-sided conveyance roller pair 702 that conveys the sheet S immediately before the registration roller pair 304. As described above, in the state where the minimum sheet is nipped by both the registration roller pair 304 and the two-sided conveyance roller pair 702, the registration roller pair 304 is located near the downstream side edge of the minimum sheet and the two-sided conveyance roller pair 702 is located near the upstream side edge of the minimum sheet.

It is possible to reduce the number of roller pairs disposed in the printer 100 by increasing the distance between the roller pairs conveying the sheet S. As a result, it is possible to reduce the space for disposing the roller pairs, and to reduce the number of drive trains for driving the roller pairs. It is also possible to reduce the load applied to the drive source for driving the roller pairs. As a result, it becomes possible to reduce the size and cost of the printer 100.

The present invention is applicable, not only to the laser printer, but also to a copying machine, a so-called light emitting diode (LED) printer that uses a light emitting diode, and an ink-jet printer.

The upper side conveyance guide 705 (2705) and the lower side conveyance guide 706 (2706) are disposed on the two-sided conveyance path 701, but they may be disposed on a conveyance path other than the two-sided conveyance path 701. However, there may be a case where the curling occurs on the sheet S when the sheet S passes through the fixing unit 50, and the buckling of the sheet S is likely to occur. In this case also, like the printer 100 according to the present exemplary embodiment, it is possible to restrain the occurrence of the buckling of the sheet S by disposing the upper side conveyance guide 705 (2705) and the lower side conveyance guide 706 (2706) on the two-sided conveyance path 701 on the downstream side of the fixing unit 50.

As described above, according to the present invention, it is possible to restrain the buckling of the sheet S in the conveyance apparatus configured to convey the sheet.

The present application discloses at least the following.

Configuration 1

A conveyance apparatus configured to convey a sheet, the conveyance apparatus comprising:

a first conveyance roller pair configured to convey the sheet, the first conveyance roller pair including a first roller and a first opposing roller opposing the first roller;

a second conveyance roller pair configured to convey the sheet toward the first conveyance roller pair, the second conveyance roller pair including a second roller and a second opposing roller opposing the second roller, the second conveyance roller pair configured to convey the sheet such that the sheet reaches a position at which the sheet contacts the first conveyance roller pair;

a moving member configured to move between a restricting position at which the moving member restricts the sheet from reaching the first conveyance roller pair, and a retracting position retracted from the restricting position, the moving member being moved from the restricting position to the retracting position by being pushed by the sheet;

a first guide configured to guide the sheet conveyed by the second conveyance roller pair, the first guide being disposed between the moving member and the second conveyance roller pair; and a first opposing guide configured to guide the sheet conveyed by the second conveyance roller pair, the first opposing guide being disposed between the moving member and the second conveyance roller pair to oppose the first guide, wherein one of the first guide and the first opposing guide includes a first curved portion which the sheet contacts, and the other of the first guide and the first opposing guide includes a second curved portion which the sheet contacts, and wherein the second conveyance roller pair conveys the sheet such that the sheet contacts the second curved portion after contacting the first curved portion.

Configuration 2

The conveyance apparatus according to configuration 1, further comprising a second guide configured to guide the sheet conveyed by the second conveyance roller pair toward the first conveyance roller pair, wherein the second guide is a U-turn guide configured to turn around the sheet conveyed by the second conveyance roller pair.

Configuration 3

The conveyance apparatus according to configuration 1, further comprising a second guide configured to guide the sheet conveyed by the second conveyance roller pair toward the first conveyance roller pair, wherein the second guide configured to curve the sheet such that a moving direction of a leading edge of the sheet changes from a direction away from the first conveyance roller pair to a direction approaching the first conveyance roller pair.

Configuration 4

The conveyance apparatus according to configuration 2 or 3, wherein the first guide and the first opposing guide are disposed between the second guide and the second conveyance roller pair.

Configuration 5

The conveyance apparatus according to any one of configurations 1 to 4, wherein a radius of the first curved portion is larger than a radius of the second curved portion.

Configuration 6

The conveyance apparatus according to any one of configurations 1 to 5, wherein the one of the first guide and the first opposing guide includes a third curved portion which the sheet contacts, and wherein the second conveyance roller pair conveys the sheet such that the sheet contacts the third curved portion after the sheet contacts the second curved portion.

Configuration 7

The conveyance apparatus according to configuration 6, wherein the first guide is disposed above the first opposing guide in a vertical direction.

Configuration 8

The conveyance apparatus according to configuration 7, wherein the first curved portion and the third curved portion are provided in the first guide.

Configuration 9

The conveyance apparatus according to any one of configurations 6 to 8, wherein a radius of the third curved portion is larger than a radius of the first curved portion.

Configuration 10

The conveyance apparatus according to any one of configurations 1 to 9, wherein, viewed in a rotational axis direction of the second roller, when a straight line connecting a center of the second roller and a center of the second opposing roller is defined as a first straight line, and a straight line orthogonal to the first straight line and passing through a contact position at which the second roller and the second opposing roller contact is defined as a second straight line, the first curved portion is disposed so that the second straight line and the first curved portion intersect.

Configuration 11

The conveyance apparatus according to configuration 10, wherein a parallel portion parallel to the second straight line is provided between the first conveyance roller pair and the first curved portion.

Configuration 12

The conveyance apparatus according to any one of configurations 1 to 11, wherein the first roller and the moving member are rotatable around a first axis line.

Configuration 13

The conveyance apparatus according to any one of configurations 1 to 12, wherein in a case where a sheet having a minimum size of the sheet conveyable by the first conveyance roller pair and the second conveyance roller pair is defined as a minimum sheet, and when the minimum sheet is nipped by the first conveyance roller pair and the second conveyance roller pair, the first conveyance roller pair and the second conveyance roller pair are disposed such that 45% or more of a length of the minimum sheet in a conveyance direction of the minimum sheet by the first conveyance roller pair and the second conveyance roller pair is located between the first conveyance roller pair and the second conveyance roller pair.

Configuration 14

The conveyance apparatus according to any one of configurations 1 to 13, wherein a radius of the first curved portion is greater than or equal to 90 mm (millimeters) and smaller than or equal to 160 mm.

Configuration 15

The conveyance apparatus according to configuration 14, wherein a radius of the second curved portion is greater than or equal to 90 mm and smaller than or equal to 160 mm.

Configuration 16

The conveyance apparatus according to any one of configurations 1 to 15, wherein, when the sheet is nipped by the first conveyance roller pair and the second conveyance roller pair, the first conveyance roller pair and the second conveyance roller pair are disposed such that greater than or equal to 100 mm of the sheet is located between the first conveyance roller pair and the second conveyance roller pair.

Configuration 17

The conveyance apparatus according to any one of configurations 1 to 16, wherein, when the sheet is nipped by the first conveyance roller pair and the second conveyance roller pair, the first conveyance roller pair and the second conveyance roller pair are disposed such that greater than or equal to 180 mm of the sheet is located between the first conveyance roller pair and the second conveyance roller pair.

Configuration 18

An image forming apparatus configured to form an image on a sheet, the image forming apparatus comprising:

the conveyance apparatus according to any one of configurations 1 to 17;

a sheet stacking unit on which the sheet is stacked; and an image forming unit configured to form an image on the sheet conveyed from the sheet stacking unit.

Configuration 19

The image forming apparatus according to configuration 18, further comprising:

a first conveyance path through which the sheet conveyed from the sheet stacking unit toward the image forming unit passes; and a second conveyance path through which the sheet conveyed toward the image forming unit again after the image is formed by the image forming unit passes, and configured to be connected to the first conveyance path at a junction, wherein the first conveyance roller pair is disposed between the junction and the image forming unit, and configured to convey the sheet toward the image forming unit, and wherein the second conveyance roller pair, the first guide, and the first opposing guide are disposed on the second conveyance path.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-014684, filed Feb. 2, 2022, which is hereby incorporated by reference herein in its entirety.

What is claimed is:

1. A conveyance apparatus configured to convey a sheet, the conveyance apparatus comprising:

a first conveyance roller pair configured to convey the sheet, the first conveyance roller pair including a first roller and a first opposing roller opposing the first roller;

a second conveyance roller pair configured to convey the sheet toward the first conveyance roller pair, the second conveyance roller pair including a second roller and a second opposing roller opposing the second roller, the second conveyance roller pair configured to convey the sheet towards the first conveyance roller pair;

a moving member configured to move between a restricting position at which the moving member is configured to restrict the sheet from reaching the first conveyance roller pair, and a retracting position retracted from the restricting position;

a first guide configured to guide the sheet conveyed by the second conveyance roller pair, the first guide being disposed between the moving member and the second conveyance roller pair;

a first opposing guide configured to guide the sheet conveyed by the second conveyance roller pair, the first opposing guide being disposed between the moving member and the second conveyance roller pair to oppose the first guide; and a second guide configured to guide the sheet conveyed by the second conveyance roller pair toward the first conveyance roller pair, wherein the second guide is a U-turn guide configured to turn around the sheet conveyed by the second conveyance roller pair, wherein the second conveyance roller pair is configured to convey the sheet such that (i) the sheet moves the moving member from the restricting position to the retracting position after the sheet contacts the moving member positioned at the restricting portion and skew of the sheet is corrected and (ii) the sheet reaches a position at which the sheet contacts the first conveyance roller pair, wherein one of the first guide and the first opposing guide includes a first curved portion which the sheet contacts, and the other of the first guide and the first opposing guide includes a second curved portion which the sheet contacts, and wherein the second conveyance roller pair is configured to convey the sheet such that (i) the sheet contacts the second curved portion after contacting the first curved portion, and then the sheet reaches the moving member and (ii) the sheet is delivered to the first conveyance roller pair in a curved state in which the sheet is curved by the first curved portion and the second curved portion.

2. The conveyance apparatus according to claim 1, further comprising a second guide configured to guide the sheet conveyed by the second conveyance roller pair toward the first conveyance roller pair, wherein the second guide configured to curve the sheet such that a moving direction of a leading edge of the sheet changes from a direction away from the first conveyance roller pair to a direction approaching the first conveyance roller pair.

3. The conveyance apparatus according to claim 1, wherein the first guide and the first opposing guide are disposed between the second guide and the second conveyance roller pair.

4. The conveyance apparatus according to claim 1, wherein a radius of the first curved portion is larger than a radius of the second curved portion.

5. The conveyance apparatus according to claim 1, wherein the one of the first guide and the first opposing guide includes a third curved portion which the sheet contacts, and wherein the second conveyance roller pair is configured to convey the sheet such that the sheet contacts the third curved portion after the sheet contacts the second curved portion.

6. The conveyance apparatus according to claim 5, wherein the first guide is disposed above the first opposing guide in a vertical direction.

7. The conveyance apparatus according to claim 6, wherein the first curved portion and the third curved portion are provided in the first guide.

8. The conveyance apparatus according to claim 5, wherein a radius of the third curved portion is larger than a radius of the first curved portion.

9. The conveyance apparatus according to claim 1, wherein, viewed in a rotational axis direction of the second roller, when a straight line connecting a center of the second roller and a center of the second opposing roller is defined as a first straight line, and a straight line orthogonal to the first straight line and passing through a contact position at which the second roller and the second opposing roller contact is defined as a second straight line, the first curved portion is disposed so that the second straight line and the first curved portion intersect.

10. The conveyance apparatus according to claim 9, wherein a parallel portion parallel to the second straight line is provided between the second conveyance roller pair and the first curved portion.

11. The conveyance apparatus according to claim 1, wherein the first roller and the moving member are rotatable around a first axis line.

12. The conveyance apparatus according to claim 1, wherein in a case where a sheet having a minimum size of the sheet conveyable by the first conveyance roller pair and the second conveyance roller pair is defined as a minimum sheet, and when the minimum sheet is nipped by the first conveyance roller pair and the second conveyance roller pair, the first conveyance roller pair and the second conveyance roller pair are disposed such that 45% or more of a length of the minimum sheet in a conveyance direction of the minimum sheet by the first conveyance roller pair and the second conveyance roller pair is located between the first conveyance roller pair and the second conveyance roller pair.

13. An image forming apparatus configured to form an image on a sheet, the image forming apparatus comprising:

a conveyance apparatus configured to convey a sheet, the conveyance apparatus comprising:

a first conveyance roller pair configured to convey the sheet, the first conveyance roller pair including a first roller and a first opposing roller opposing the first roller;

a second conveyance roller pair configured to convey the sheet toward the first conveyance roller pair, the second conveyance roller pair including a second roller and a second opposing roller opposing the second roller, the second conveyance roller pair configured to convey the sheet towards the first conveyance roller pair;

a moving member configured to move between a restricting position at which the moving member is configured to restrict the sheet from reaching the first conveyance roller pair, and a retracting position retracted from the restricting position;

a first guide configured to guide the sheet conveyed by the second conveyance roller pair, the first guide being disposed between the moving member and the second conveyance roller pair; and a first opposing guide configured to guide the sheet conveyed by the second conveyance roller pair, the first opposing guide being disposed between the moving member and the second conveyance roller pair to oppose the first guide;

a sheet stacking unit on which the sheet is stacked;

an image forming unit configured to form an image on the sheet conveyed from the sheet stacking unit;

a first conveyance path through which the sheet conveyed from the sheet stacking unit toward the image forming unit passes; and a second conveyance path through which the sheet conveyed toward the image forming unit again after the image is formed by the image forming unit passes, the second conveyance path being connected to the first conveyance path at a junction, wherein the second conveyance roller pair is configured to convey the sheet such that (i) the sheet moves the moving member from the restricting position to the retracting position after the sheet contacts the moving member positioned at the restricting portion and skew of the sheet is corrected and (ii) the sheet reaches a position at which the sheet contacts the first conveyance roller pair, wherein one of the first guide and the first opposing guide includes a first curved portion which the sheet contacts, and the other of the first guide and the first opposing guide includes a second curved portion which the sheet contacts, and wherein the second conveyance roller pair is configured to convey the sheet such that (i) the sheet contacts the second curved portion after contacting the first curved portion, and then the sheet reaches the moving member and (ii) the sheet is delivered to the first conveyance roller pair in a curved state in which the sheet is curved by the first curved portion and the second curved portion, wherein the first conveyance roller pair is disposed between the junction and the image forming unit, and conveys the sheet toward the image forming unit, and wherein the second conveyance roller pair, the first guide, and the first opposing guide are disposed on the second conveyance path.

14. The image forming apparatus according to claim 13, wherein, each of the first curved portion and the second curved portion is concave.

15. The conveyance apparatus according to claim 1, wherein, each of the first curved portion and the second curved portion is concave.

16. The conveyance apparatus according to claim 13, further comprising a second guide configured to guide the sheet conveyed by the second conveyance roller pair toward the first conveyance roller pair, wherein the second guide is a U-turn guide configured to turn around the sheet conveyed by the second conveyance roller pair.

17. The conveyance apparatus according to claim 16, wherein the first guide and the first opposing guide are disposed between the second guide and the second conveyance roller pair.

18. A conveyance apparatus configured to convey a sheet, the conveyance apparatus comprising:

a first conveyance roller pair configured to convey the sheet, the first conveyance roller pair including a first roller and a first opposing roller opposing the first roller;

a second conveyance roller pair configured to convey the sheet toward the first conveyance roller pair, the second conveyance roller pair including a second roller and a second opposing roller opposing the second roller, the second conveyance roller pair configured to convey the sheet towards the first conveyance roller pair;

a moving member configured to move between a restricting position at which the moving member is configured to restrict the sheet from reaching the first conveyance roller pair, and a retracting position retracted from the restricting position;

a first guide configured to guide the sheet conveyed by the second conveyance roller pair, the first guide being disposed between the moving member and the second conveyance roller pair; and a first opposing guide configured to guide the sheet conveyed by the second conveyance roller pair, the first opposing guide being disposed between the moving member and the second conveyance roller pair to oppose the first guide; and wherein the second conveyance roller pair is configured to convey the sheet such that (i) the sheet moves the moving member from the restricting position to the retracting position after the sheet contacts the moving member positioned at the restricting portion and skew of the sheet is corrected and (ii) the sheet reaches a position at which the sheet contacts the first conveyance roller pair, wherein one of the first guide and the first opposing guide includes a first curved portion which the sheet contacts, and the other of the first guide and the first opposing guide includes a second curved portion which the sheet contacts, and wherein the second conveyance roller pair is configured to convey the sheet such that (i) the sheet contacts the second curved portion after contacting the first curved portion, and then the sheet reaches the moving member and (ii) the sheet is delivered to the first conveyance roller pair in a curved state in which the sheet is curved by the first curved portion and the second curved portion, wherein the one of the first guide and the first opposing guide includes a third curved portion which the sheet contacts, and wherein the second conveyance roller pair is configured to convey the sheet such that the sheet contacts the third curved portion after the sheet contacts the second curved portion.

19. The conveyance apparatus according to claim 18, wherein a radius of the first curved portion is larger than a radius of the second curved portion.

20. The conveyance apparatus according to claim 18, wherein a radius of the third curved portion is larger than a radius of the first curved portion.

* * * * *